US012692752B2

(12) United States Patent
Zbaraskiy et al.

(10) Patent No.: US 12,692,752 B2
(45) Date of Patent: Jul. 28, 2026

(54) DRILL BIT

(71) Applicant: NOV DOWNHOLE EURASIA LIMITED, Gloucestershire (GB)

(72) Inventors: Vasiliy Zbaraskiy, Aberdeenshire (GB); Benoit Botton, Bristol (GB); Robert Peter Douglas Tipples, Cheltenham (GB)

(73) Assignee: NOV DOWNHOLE EURASIA LIMITED, Gloucestershire (GB)

( * ) Notice: Subject to any disclaimer, the term of this patent is extended or adjusted under 35 U.S.C. 154(b) by 0 days.

(21) Appl. No.: 18/294,926

(22) PCT Filed: Jul. 28, 2022

(86) PCT No.: PCT/EP2022/071226
§ 371 (c)(1),
(2) Date: Feb. 2, 2024

(87) PCT Pub. No.: WO2023/016821
PCT Pub. Date: Feb. 16, 2023

(65) Prior Publication Data

US 2024/0247548 A1 Jul. 25, 2024

(30) Foreign Application Priority Data

Aug. 12, 2021 (GB) ..... 2111604

(51) Int. Cl.
*E21B 10/60* (2006.01)
*E21B 10/61* (2006.01)

(52) U.S. Cl.
CPC ..... *E21B 10/602* (2013.01); *E21B 10/61* (2013.01)

(58) Field of Classification Search
CPC ..... E21B 10/602; E21B 10/61
See application file for complete search history.

(56) References Cited

U.S. PATENT DOCUMENTS

| | | | |
|---|---|---|---|
| 4,452,324 | A | 6/1984 | Juergens |
| 4,460,053 | A | 7/1984 | Juergens et al. |
| 4,606,418 | A | 8/1986 | Thompson |

(Continued)

FOREIGN PATENT DOCUMENTS

| | | | |
|---|---|---|---|
| CN | 104612594 A | | 5/2015 |
| CN | 204552622 U | * | 8/2015 |
| CN | 204552623 U | | 8/2015 |

OTHER PUBLICATIONS

Combined Search and Examination Report dated Apr. 20, 2022, for GB Application No. 2111604.1 (11 p.).

(Continued)

*Primary Examiner* — D. Andrews
(74) *Attorney, Agent, or Firm* — CONLEY ROSE, P.C.

(57) ABSTRACT

A drill bit comprises a bit body having a body face and a plurality of blades each extending from the bit body from a root portion adjacent the body face to a tip portion defining a cutting region, each blade having a leading face and a trailing face. The drill bit further comprises at least one outlet port disposed adjacent the leading face of at least one blade at a location between the root and tip portions of said at least one blade, the at least one outlet port for directing drilling fluid towards the cutting region of the at least one blade.

22 Claims, 4 Drawing Sheets

(56) References Cited

U.S. PATENT DOCUMENTS

| | | | | |
|---|---|---|---|---|
| 6,311,793 | B1 * | 11/2001 | Larsen | E21B 10/18 175/393 |
| 10,975,628 | B2 | 4/2021 | Xu et al. | |
| 2010/0276206 | A1 * | 11/2010 | Borissov | E21B 10/602 76/108.1 |
| 2017/0044837 | A1 | 2/2017 | Moslemi et al. | |
| 2018/0002986 | A1 * | 1/2018 | Zhang | E21B 10/43 |
| 2019/0323296 | A1 | 10/2019 | Gan et al. | |

OTHER PUBLICATIONS

PCT/EP2022/071226 International Search Report and Written Opinion dated Sep. 28, 2022 (13 p.).

* cited by examiner

DRILL BIT

CROSS-REFERENCE TO RELATED APPLICATIONS

The present application is a 35 U.S.C. § 371 U.S. National Phase entry of, and claims priority to PCT/EP2022/071226 filed Jul. 28, 2022, and entitled "Drill Bit," which claims priority to GB 2111604.1 filed Aug. 12, 2021, and entitled "Drill Bit," each of which is hereby incorporated herein by reference in its entirety for all purposes.

STATEMENT REGARDING FEDERALLY SPONSORED RESEARCH OR DEVELOPMENT

Not applicable.

FIELD

The present disclosure relates to a drill bit for use in drilling wellbores.

BACKGROUND

Rotary drill bits are typically mounted on the lower end of a drill string and rotated either by rotation of the entire string from surface or via downhole motors. As the drill string is rotated, tension applied to the drill string is reduced to increase the weight on the bit so that the bit engages and drills a borehole into the earthen formation.

Drill bits typically utilise drilling fluid as a means to flush the drilled earth away from the drill bit and transport it to the surface while also cleaning and cooling the drill bit components, particularly cutting elements. While the bit is rotated, drilling fluid is pumped through the drill string and directed out of the face of the drill bit through one or more nozzles. The behaviour and performance of the drilling fluid as it acts on and around the drill bit is known as "bit hydraulics".

Fixed cutter drill bits are known which include fixed blades extending from a body face of a bit body and which carry cutting elements. In this example drilling fluid nozzles are provided in the body face and are oriented such that high velocity drilling fluid is directed toward the formation at the bottom of the hole. As the drilling fluid impacts the formation and returns upward past the face of the drill bit it cleans and cools the cutting elements. By the time the drilling fluid contacts the cutting elements the velocity of the drilling fluid is reduced from its initial nozzle exit velocity, which may limit the amount of cooling and cleaning that can be achieved. In this respect inadequate cooling of the cutting elements may lead to decreased life of the drill bit due to high temperatures supporting increased erosion and wear of the cutting elements. Further, if formation cuttings are not cleaned from the cutting elements, formation materials may build up on the cutting elements and greatly increase drilling times and efficiencies.

Some types of earthen formations, such as plastic shales or plastic formations, are difficult to drill efficiency. Upon action of the cutting elements, these formations generate cuttings in the form of long ribbons of drilled material that tend to accumulate between the cutting elements of the drill bit, a phenomenon called "bit balling". When the bit is balled, it is no longer possible for the cutting elements to engage the formation, regardless of the weight applied on the bit. Drilling of the borehole pauses for the drill bit to be retrieved and cleaned by means other than pumping drilling fluid through the drill string, which may become ineffective over time.

SUMMARY

An aspect of the present disclosure relates to a drill bit, comprising:

a bit body having a body face;

a plurality of blades each extending from the bit body from a root portion adjacent the body face to a tip portion defining a cutting region, each blade having a leading face and a trailing face; and at least one outlet port disposed adjacent the leading face of at least one blade at a location between the root and tip portions of said at least one blade, the at least one outlet port for directing drilling fluid towards the cutting region of the at least one blade.

Providing the at least one outlet port between the root and tip portions of a blade, and thus closer to the associated blade cutting region, may assist to provide preferential fluid mechanics (e.g., bit hydraulics) and permit more efficient utilisation of the drilling fluid. For example, by virtue of the drilling fluid travelling over a shorter distance following exit from the at least one outlet port, relative to nozzles provided in the body face, the drilling fluid may be subject to lower dispersal and energy loss upon reaching the associated cutting region. This may provide a number of benefits. For example, the ability to deliver drilling fluid at a higher force at the cutting region may result in increased ability for the drilling fluid to remove or flush drill cuttings from the cutting region.

Furthermore, the closer proximity of the at least one outlet port to the cutting region may permit improved focussing or targeting of the drilling fluid at the cutting region. In particular, by disposing the at least one outlet port adjacent the leading face of a blade and in closer proximity to the cutting region, drilling fluid may be directed more precisely towards the cutting region. This may in particular improve the ability for the drilling fluid to impinge at a location between the cutting region and drill cuttings in the process of being removed from the borehole. That is, the drilling fluid, for example a jet of drilling fluid from the at least one outlet port, may be directed more accurately beneath drill cuttings being sheared from the bottom of the bore hole, effectively assisting to lift the drill cuttings away from the cutting edge. This precise targeting combined with the above described higher velocity fluid jet and shear force may assist to separate or sever the drill cuttings, preventing long ribbons from being formed and reducing the risk of bit balling (or other binding phenomenon) occurring. Such focussed directing of the drilling fluid may contrast with a jet of drilling fluid from a typical nozzle provided in the body face of a drill bit, in which a wider fluid jet with reduced energy or force may impinge on the outside of drill cuttings.

Also, the improved bit hydraulics associated with the present disclosure, particularly the higher momentum drilling fluid being more accurately focussed on the cutting region, may improve the cooling effect to the drill bit at the cutting region. This cooling effect may be improved further by the enhanced removal of drill cuttings, thus providing a cooling synergy between higher fluid momentum and better management and removal of drill cuttings.

The at least one outlet port is located partway between the root and tip portions of an associated blade. This arrangement is such that the at least one outlet port is elevated or raised relative to the body face, and may also may be considered to be more immediately below the cutting region. In this respect while the terms "elevated" and "below", and similar terms, are used these are not intended to mean being vertically above the body face or below the cutting region, as it will be recognised that the drill bit may be used in any orientation. With this in mind, "elevated", for example, is intended to mean that the at least one outlet port lies outside of the profile or envelope of the body face, towards the tip portion of an associated blade.

The at least one outlet port may be located closer to the tip portion of the at least one blade than the root portion.

The at least one outlet port may be disposed (e.g., mounted on or supported by) on the leading face of the at least one blade. The at least one outlet port may be disposed on infrastructure associated with (e.g., connected to, forming part of etc.) the leading face of the at least one blade. The at least one outlet port may be disposed on a projection extending outwardly from the leading face of at least one blade. In this respect the projection may extend outwardly from the leading face of the at least one blade in a direction towards the trailing face of an adjacent blade. The space between the leading face of one blade and the trailing face of an adjacent blade may be defined as a junk slot. As such, the projection may extend from the leading face of the at least one blade into an associated junk slot.

The projection may define a ledge, wherein the at least one outlet port is formed in or on the ledge. The ledge may provide a stepped profile on the leading face of the at least one blade. The ledge may extend in any orientation relative to the leading face of the blade. In some examples the ledge may be perpendicular, at least along a part of its length, relative to the leading face of the blade. The ledge may be sloped or inclined, at least along a part of its length, relative to the leading face of the blade. The ledge may be planar, curved etc. The ledge may extend in an orientation to provide a preferential orientation of the at least one outlet port, for example to ensure a preferential focus or pointing towards the associated cutting region. The ledge may define a profile along its length. The profile may follow a profile of the tip portion of the at least one blade.

The ledge may provide additional functionality other than disposing the at least one port at its elevated position. In one example the ledge may function as or define a flow guide to guide flow from a separate flow source towards the cutting region of the at least one blade. As will be described in more detail below, the separate flow source may be provided by one or more drilling fluid nozzles disposed on the bit body. Thus, in the present example the drill bit may comprise a flow guide disposed on a leading face of at least one blade, wherein at least one outlet port is disposed on the flow guide. Such an arrangement may provide significant advantages in improving bit hydraulics.

The projection may be a discrete projection located between the root and tip portions of the blade. The projection may extend (for example extend upwardly, noting that this is not limited to a precise vertical orientation sense) from the body face of the bit body in the same direction as at least a portion of the at least one blade. The projection may extend from a projection root adjacent the body face to a projection tip intermediate the root and tip portions of the at least one blade. The projection tip may define the ledge for accommodating the at least one outlet port.

The projection may be integrally formed with the at least one blade, for example in a single forming process such as casting, additive manufacturing etc. The projection may be separately formed and secured to the at least one blade, for example via welding, bonding, fastening etc.

A single projection may accommodate a single outlet port. In such an example, where multiple outlet ports are required on a single blade, multiple projections may be present on the leading face of said single blade. A single projection may accommodate multiple outlet ports.

The drill bit may define a feed bore for accommodating the flow of drilling fluid therein. The at least one outlet port may be in fluid communication with the feed bore. The drill bit may define an auxiliary flow bore extending between the feed bore and the at least one outlet port. The auxiliary flow bore may define a profile, for example in proximity to the at least one outlet port to assist in providing a desired outlet flow profile of drilling fluid. For example, the auxiliary flow bore may define a converging profile, diverging profile, straight profile, swirl profile (for example to impart a swirl component to the drilling fluid), etc.

The at least one outlet port may be of any form. In one example, the at least one outlet port may be generally elongate, for example in a direction generally parallel with the leading face of the at least one blade. Such elongation may permit a required flow area to be achieved while minimising the extent to which a projection extends from the leading face of the at least one blade (i.e., the extent of extension into a junk slot). Furthermore, an elongated outlet port may permit a wider fan profile to be achieved, thus provided a wider coverage along the cutting region from a single outlet port.

The elongate shape of the at least one outlet port may mitigate against blockage from drill cuttings. That is, the elongate shape may promote a degree of self-cleaning. For example, should a drill cutting transfer into the outlet port it is less likely to entirely block the elongate port. With a partial blockage or restriction the remaining flow space would be reduced which would result in a higher flow speed and therefore increase the shear forces on the drill cutting in the port. The increased shear force may translate to an increased force to clear the blockage.

Furthermore, the closer proximity of the at least one outlet port to the cutting region may be such that the drill cuttings may be of a smaller size by the time they may encroach or enter the at least one outlet port, providing further assurances against blockages. As such, the proximity of the at least one outlet port and the elongated shape may provide a synergistic effect in mitigating against blockage form drill cuttings.

The at least one outlet port may be rectangular. The at least one outlet port may be generally oval. The at least one outlet port may be generally stadium shaped. The at least one outlet port may define a varying geometry along its length. Such an arrangement may allow a preferential flow profile to be achieved, for example to further promote self-cleaning, to provide greater or lesser flow of drilling fluid in certain locations of the cutting regions etc. Such a varying geometry may be achieved by a tapered slot profile tear-shaped profile, sequence of connected differing profiles, such as round and rectangular profiles and/or the like.

The at least one outlet port may have any desired length. In one example the at least one outlet port may define a length equal to or greater than a cutting width of a cutting element which may be provided in the cutting region of the blade. In such an arrangement the outlet port may have a length which is at least the same size (or larger) than the width of any drill cuttings which could be produced by the cutting element.

In some examples a single outlet port may be disposed adjacent the leading face of at least one blade. Multiple outlet ports may be disposed adjacent the leading face of at least one blade.

The drill bit may comprise at least one outlet port disposed adjacent the leading face of two or more blades. For example, the drill bit may comprise at least one outlet port disposed adjacent the leading face of each blade. The form of the outlet ports and all associated features, may be similar to that described above. In some examples the same number of outlet ports may be provided in each blade. Alternatively, a differing number of outlet ports may be provided between two or more blades, for example one blade may include more outlet ports than a different blade. Such an arrangement may be determined by factors such as the length of the blade, the length of the cutting region, the number of cutting elements provided on the blade etc.

As suggested above, the cutting region of each blade may comprise at least one cutting element. The at least one cutting element may be provided on the leading face of each blade. For example, the at least one cutting element may project from the leading face of each blade. In such an example the at least one cutting element may project at least partially over the at least one port. Such an arrangement may further improve bit hydraulics while also allowing cleaning of the cutting elements without relying on rotation of the drill bit.

The at least one cutting element may be provided on a shoulder defined between the leading face and a tip face of each blade. The at least one cutting element may be provided in a known form, for example in terms of geometry, material composition, attachment mechanism, manufacturing technique etc. The cutting region of each blade may comprise a plurality of cutting elements. The plurality of cutting elements may be provided side-by-side along an associated cutting region of the blade.

The body face may define a body face profile. The body face profile may be convex, domed, hemispherical, conical, parabolic and/or the like. The blades may define a blade profile. The blade profile may be defined in a radial direction of the drill bit. In some examples the blade profile may be similar to the body face profile. For example, root and tip portions of the blade may substantially follow the profile of the body face.

The drill bit may comprise a plurality of nozzles disposed on the body face of the drill bit to allow the flow of drilling fluid out of the bit body. The nozzles may be in communication with the feed bore of the drill bit. As such, the drill bit accommodates outflow of drilling fluid via both the at least one outlet port and the plurality of nozzles on the body face. In this example, the presence of the at least one outlet port improves the bit hydraulics which could otherwise be provided solely by the nozzles.

The nozzles may be at least one of flush with and recessed relative to the body surface.

At least one nozzle may be associated with each junk slot of the drill bit (as described above, a junk slot is defined between the leading face of one blade and the trailing face of an adjacent blade). Such association may be achieved by a nozzle being arranged such that drilling fluid ejected therefrom may be directed towards or into a junk slot. This may be achieved by the nozzle being located within the junk slot (i.e., between adjacent blades) or by being pointed or directed towards a junk slot.

The drill bit may define a longitudinal axis. The drill bit may be rotatable about the longitudinal axis. The blades may extend or be aligned generally radially relative to the longitudinal axis. One or more of the blades may be swept relative to the longitudinal axis. The blades may define fixed blades. As such, the drill bit may be defined as a fixed cutter bit. The blades may be distributed circumferentially relative to each other. For example, distributed around the longitudinal axis. The blades may be identical to each other. Alternatively, at least two blades may differ from each other.

A method for drilling a bore, comprising:

engaging a drill bit against a formation to be drilled, the drill bit comprising a bit body having a body face and a plurality of blades each extending from the bit body from a root portion adjacent the body face to a tip portion defining a cutting region, each blade having a leading face and a trailing face;

rotating the drill bit to cause the cutting region of each blade to remove material from the formation to produce drill cuttings; and flowing drilling fluid from at least one outlet port which is disposed adjacent the leading face of at least one blade at a location between the root and tip portions of said at least one blade, the drilling fluid being directed towards the cutting region of the at least one blade.

The method for drilling a bore may be provided by use of a drill bit according to any other aspect. As such, features defined in relation to any other aspect may be considered applicable in the method.

The method may comprise directing drilling fluid from the at least one outlet at a location between the cutting region and drill cuttings being removed.

The method may comprise additionally flowing drilling fluid from a plurality of nozzles disposed on the body face of the bit body.

An aspect of the present disclosure relates to a drill bit, comprising:

a bit body having a body face;

a plurality of blades each extending from the bit body from a root portion adjacent the body face to a tip portion defining a cutting region, each blade having a leading face and a trailing face; and at least one outlet port disposed adjacent the leading face of each blade at a location between the respective blade root and tip portions, the at least one outlet port for directing drilling fluid towards the cutting region of each respective blade.

An aspect of the present disclosure relates to a drill bit, comprising:

a bit body having a body face;

a plurality of blades each extending from the bit body from a root portion adjacent the body face to a tip portion defining a cutting region, each blade having a leading face and a trailing face;

a plurality of nozzles disposed on the body face to flow drilling fluid out of the bit body; and at least one outlet port disposed adjacent the leading face of at least one blade at a location between the root and tip portions of said at least one blade, the at least one outlet port for directing drilling fluid towards the cutting region of the at least one blade.

An aspect of the present disclosure relates to a drill bit, comprising:

a bit body having a body face;

a plurality of blades each extending from the bit body from a root portion adjacent the body face to a tip portion defining a cutting region, each blade having a leading face and a trailing face;

a plurality of nozzles disposed on the body face to flow drilling fluid out of the bit body;

a flow guide disposed on the leading face of at least one blade, the flow guide for directing a portion of drilling fluid from at least one nozzle away from the bit body towards the cutting region of the at least one blade; and at least one outlet port disposed on a surface of the guide at a location between the root and tip portions of the at least one blade, the at least one outlet port for directing drilling fluid towards the cutting region of the at least one blade.

BRIEF DESCRIPTION OF THE DRAWINGS

These and other aspects of the present disclosure will now be described, by way of example only, with reference to the accompanying drawings, in which.

DETAILED DESCRIPTION OF THE DRAWINGS

Figure 1:
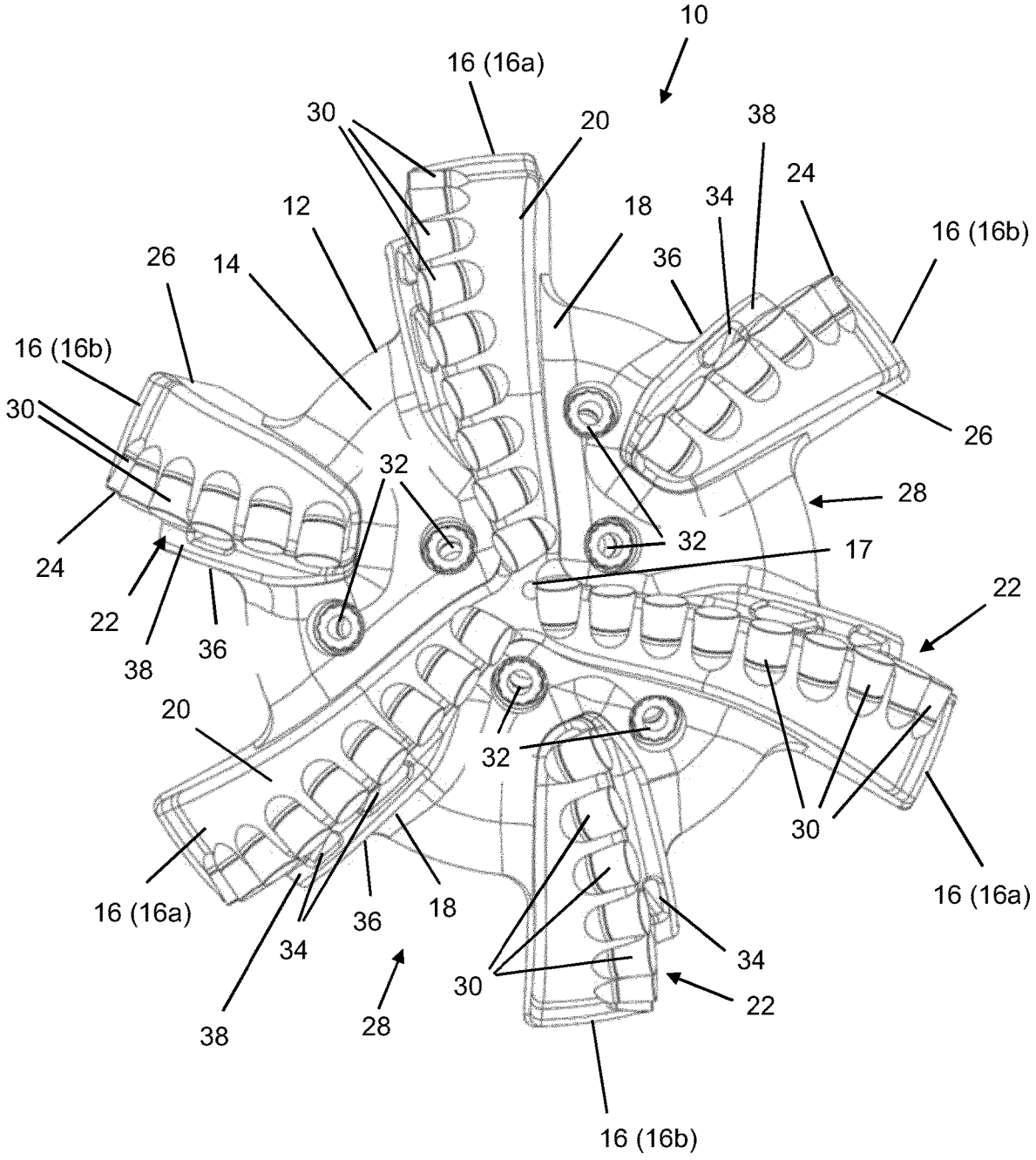
FIG. 1 is an end elevation view of a drill bit.
Figure 2:
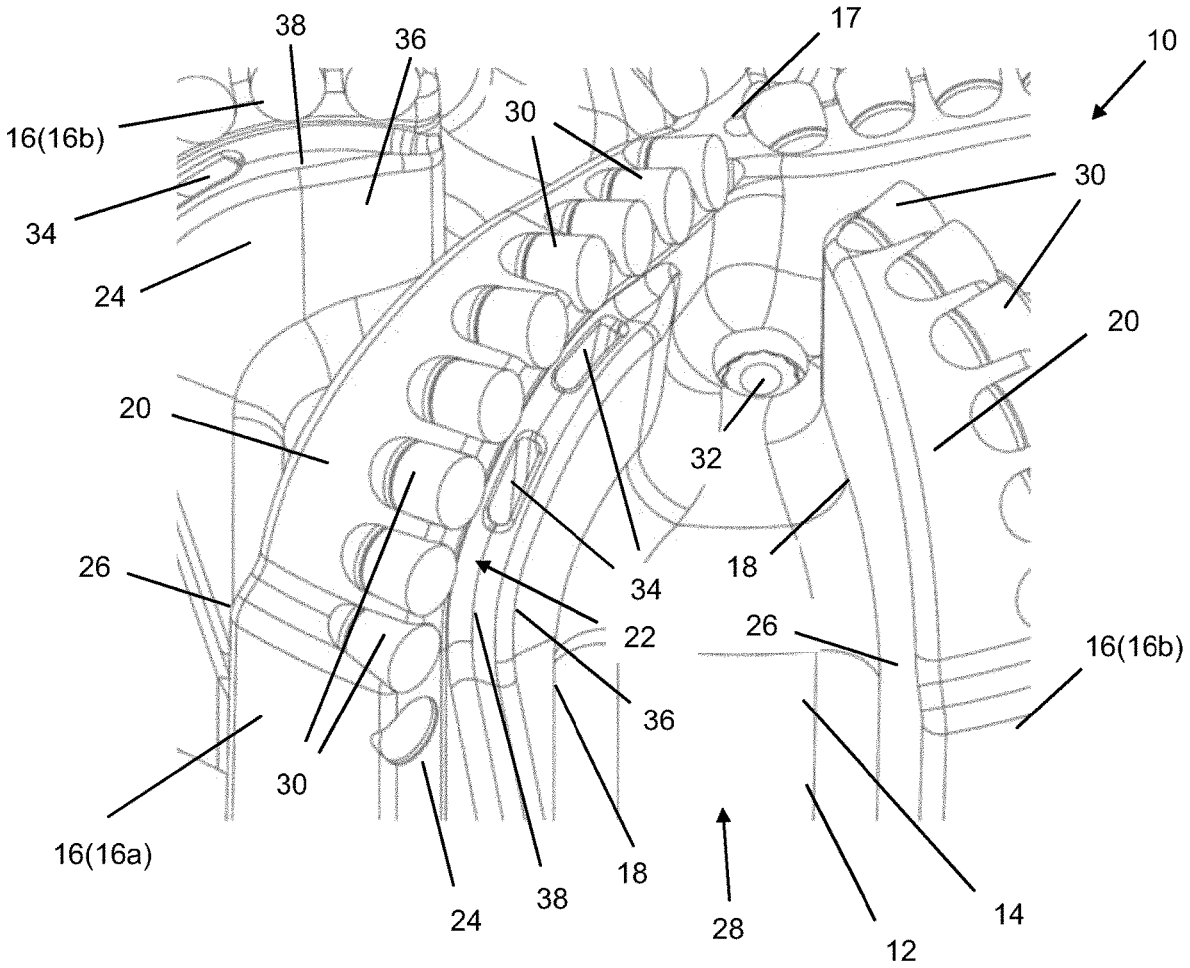
FIG. 2 is a perspective view of a portion of the drill bit of FIG. 1.

An end elevation view of a drill bit, generally identified by reference numeral 10, is provided in FIG. 1, with a perspective view of a portion of the drill bit 10 shown in FIG. 2. The drill bit 10 may be used in multiple different drilling applications. For example, the drill bit 10 may be used in the drilling of wellbores into the earth.

The drill bit 10 includes a bit body 12 having a body face 14 and a plurality of blades 16 extending from the body face 14. There are six blades 16 provided in the present example and formed of a first set of three long blades 16*a* which connect at a central hub 17, and a second set of three shorter blades 16*b* each interposed between adjacent long blades 16*a*. In this case the terms "longer" and "shorter" are with respect to a general radial length of the blades 16 with respect to a central axis of the drill bit 10. In other examples more or less blades may be provided, and they may be arranged in any suitable form. Unless explicitly mentioned otherwise it is not intended that the blades 16 are limited to the specific form or geometry illustrated. The profiles defined between the blades 16 and body surface 14 may be defined as waterways.

The blades 16 extend from the bit body 12 from a root portion 18 adjacent the body face 14 to a tip portion 20 which defines a cutting region 22. During operation, the drill bit 10 is engaged with a formation with suitable weight applied and is rotated via a connected drill string and/or motor (not shown) such that the cutting region 22 of each blade 16 removes material from the formation to produce drill cuttings. Certain features of the present disclosure relate to enabling efficient use of a drilling fluid to improve bit hydraulics aimed in particular at drill cuttings management and bit cooling. In particular, and as will be described in further detail below, the provision of one or more elevated drilling fluid outlet ports on the blades 16 can provide significant advantages.

Each blade 16 defines a leading face 24 and a trailing face 26. The designation of "leading" and "trailing" is made with reference to the intended direction of rotation to cause cutting, which in the present example is an anti-clockwise direction as viewed in FIG. 1. Respective junk slots 28 are formed between the leading face 24 of one blade 16 and the trailing face 26 of an adjacent blade 16. Each blade 16 includes a plurality of cutting elements 30 provided in each cutting region 22. More specifically, a plurality of cutting elements 30 are provided, side-by-side, on a shoulder region defined between the leading face 24 and tip region 20 of each blade 16, with the cutting elements 30 projecting from the leading faces 24 (i.e., towards or into the adjacent junk slot 28). The cutting elements 30 may be provided in a known form, for example in terms of geometry, material composition, attachment mechanism, manufacturing technique etc. Some or all of the cutting elements 30 may be integrally formed with the respective blades. Some or all of the cutting elements 30 may be provided in insert form.

The drill bit 10 comprises a plurality of nozzles 32 disposed on the body face 14 of the bit body 12 within the waterways to allow the flow of drilling fluid out of the bit body 12. The nozzles 32 are in communication with an internal feed bore (not shown) of the drill bit 10 which delivers drilling fluid from a remote location, such as a surface location in earth drilling operations. In the present example each nozzle 32 is associated with a respective junk slot 28 and delivers drilling fluid to assist in the clearing of drill cuttings from the drilled bore while also cooling the drill bit 10, particularly the cutting elements 30.

One or more outlet ports 34 are disposed on the leading face 24 of each blade 16, at a location partway between the root and tip portions 18, 20 and function to direct drilling fluid towards the cutting elements 30 in the cutting region 22 of each blade 16. In this respect, the outlet ports 34 may be considered to be elevated ports, relative to the body surface 14 of the bit body 12 and nozzles 32. This elevated position provides significant benefits, as will be described in detail below.

In the present example the blades 16 include different numbers of outlet ports 34, with the longer blades 16*a* each including two ports 34, and the shorter blades 16*b* each including a single port. Such an arrangement may be dictated by the length of the associated cutting region 22. However, different arrangements are possible, including a single outlet port provided on each blade, multiple outlet ports provided on each blade etc.

A projection 36 extends from the leading face 24 of each blade 16, into an associated junk slot 28, wherein each projection 36 defines a ledge 38, with the outlet ports 34 being formed on or in the ledges 38. As such, the outlet ports 34 are positioned below and directed towards the respective cutting regions 22 and associated cutting elements 30. The projections 36 may be integrally formed with the blades 16. Alternatively, the projections 36 may be separately formed and subsequently secured to a blade 16. In the present example the projections 36 each extend from the body face 14 of the bit body 12 to a location partway between the root and tip portions 18, 20 of each blade 16. However, in other examples one or more of the projections 36 may be considered to be discrete projections in that they may not extend from the body face 14. Rather, the projections may be provided as discrete components on the leading face of an associated blade 16.

In the present example the projections 36 and associated ledges 38 may define flow guides for use in directing a portion of drilling fluid from the nozzles 32 away from the bit body 12 and generally towards the cutting regions 22 of the blades 16.

Figure 3:
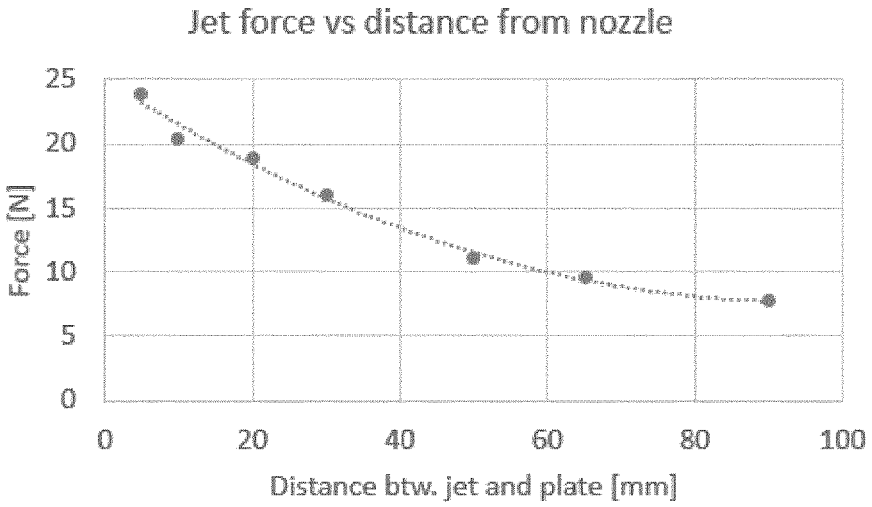
FIG. 3 graphically illustrates the relationship between jet force from a nozzle as distance increases from the nozzle.

As noted above, the presence of the elevated outlet ports 34 provides significant advantages or improvements to the bit hydraulics. For example, and as illustrated diagrammatically in FIG. 3 (the data for which was provided via CFD simulation), the jet force of drilling fluid from a nozzle or outlet reduces as the distance from the nozzle or outlet increases. Thus, the jet force from the nozzles 32 in the waterways will have diminished to a certain degree by the time the drilling fluid reaches the cutting regions 22. Providing the outlet ports 34 in a position closer to the cutting regions 22 is such that drilling fluid may reach the cutting regions 24 with higher energy and force, increasing the ability for the drilling fluid to shear drill cuttings, to remove or flush drill cuttings from the cutting region, and increase the applied cooling effect to the drill bit 10.

Figure 4:
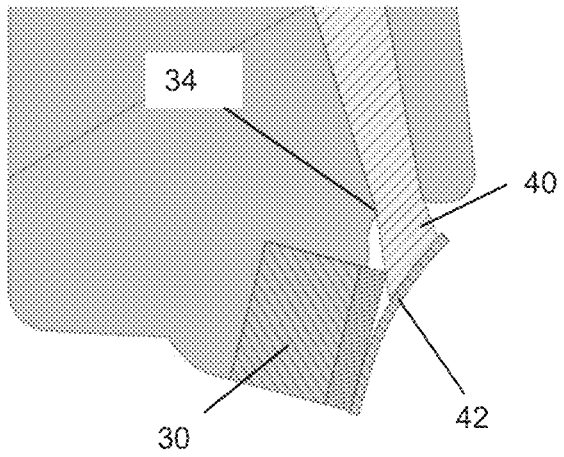
FIG. 4 is a diagrammatic illustration of the flow of drilling fluid from an outlet port of the drill bit of FIG. 1 interacting with a drill cutting when in use.
Figure 5:
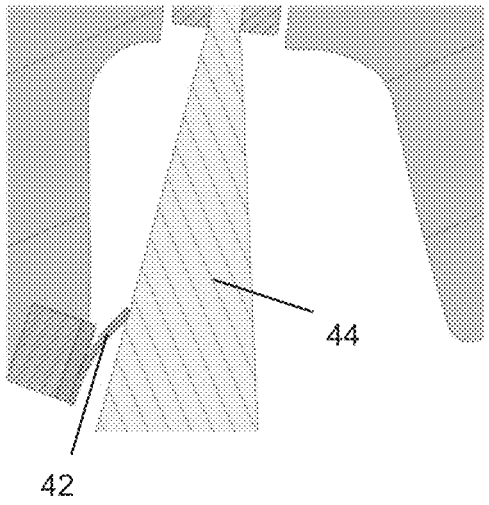
FIGURE 5 (Prior Art)
FIG. 5 is a diagrammatic illustration of the flow of drilling fluid from a nozzle typically provided on a drill bit interacting with a drill cutting.

Furthermore, the closer proximity of the outlet ports 34 to the cutting regions 22 may permit improved focussing or targeting of the drilling fluid at the cutting region 22. This may in particular improve the ability for the drilling fluid to impinge at a location between the cutting region and drill cuttings in the process of being removed from the borehole. That is, and as diagrammatically illustrated in FIG. 4, a jet or stream of drilling fluid 40 from an outlet port 34 may be directed more accurately beneath a drill cutting 42 being sheared from the bottom of the bore hole by a cutting insert 30, effectively assisting to lift the drill cutting 42 away from the cutting edge. This precise targeting combined with the above described higher velocity fluid jet and shear force may assist to separate or sever the drill cutting 42, preventing a long ribbon from being formed and reducing the risk of bit balling (or other binding phenomenon) occurring. Such focussed directing of the drilling fluid may contrast with a jet of drilling fluid from a typical waterway nozzle provided without the benefit of the present disclosure, as diagrammatically illustrated in FIG. 5, in which a wider and less targeted fluid jet 44 with reduced energy or force may impinge on the outside of a drill cutting 42 being removed.

Furthermore, the dual function of the ledges 38 (see FIGS. 1 and 2) in positioning the outlet ports 34 in their elevated position and guiding flow from the nozzles 32 towards the cutting regions 22 provides a synergy towards significantly improving bit hydraulics.

Referring again to FIGS. 1 and 2, in the present example the outlet ports 34 are generally elongate in a direction generally parallel with the leading face 24 of an associated blade 16. Such elongation may permit a required flow area to be achieved while minimising the extent to which an associated projection 36 extends from the leading face 24 of the blade (i.e., the extent of extension into a junk slot 28). Furthermore, an elongated outlet port may permit a wider fan profile to be achieved, thus providing a wider coverage along the cutting region 22 from a single outlet port.

Figure 6:
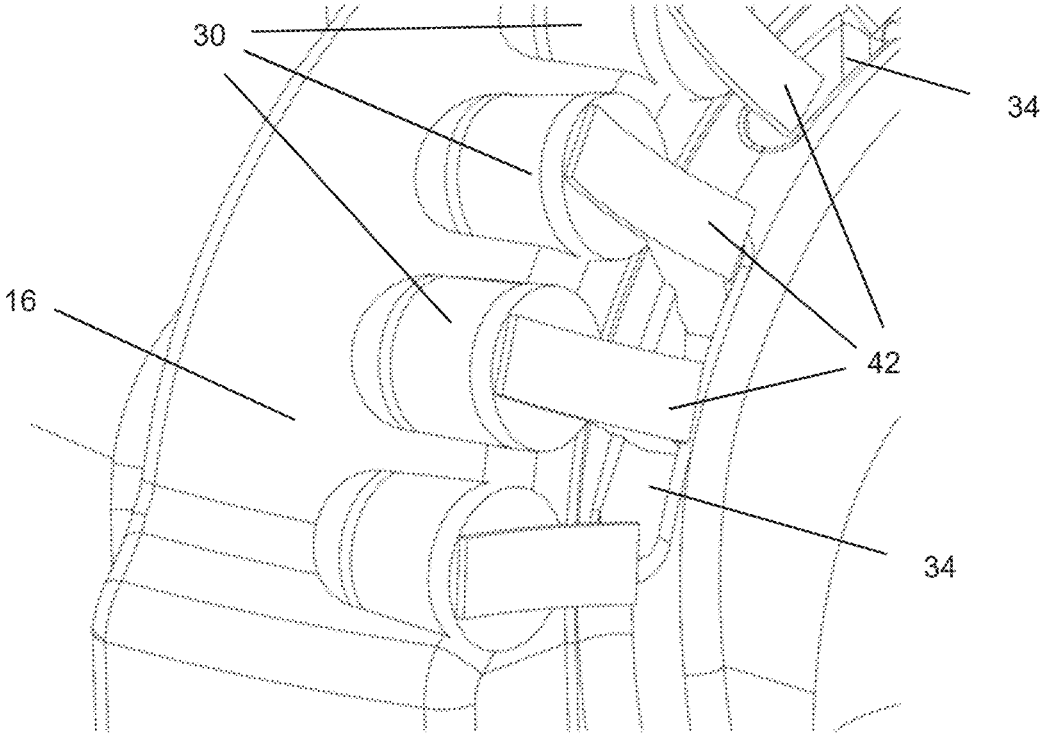
FIG. 6 is an enlarged perspective view of the drill bit of FIG. 1, in the region of cutting elements of a blade.

The elongate shape of the outlet ports 34 may also mitigate against blockage from drill cuttings. That is, the elongate shape may promote a degree of self-cleaning. For example, as illustrated in FIG. 6, should any drill cutting 42 transfer into an outlet port 34 it is less likely to entirely block the elongate port 34. With a partial blockage or restriction the remaining flow space would be reduced which would result in a higher flow speed and therefore increase the shear forces on the drill cutting in the port. The increased shear force may translate to an increased force to clear the blockage. The jet or stream of drilling fluid 40 from the outlet port 34 is not illustrated in FIG. 6 for clarity.

Furthermore, the closer proximity of the outlet ports 34 to the cutting region 22 may be such that the drill cuttings 42 are of a smaller size by the time they encroach towards or enter the outlet ports 34, providing further assurances against blockages. Also, the elongation of the outlet ports 34 may allow these to have a greater length than the individual cutting width of the cutting elements 30 such that the outlet ports 34 may be larger than the width of drill cuttings 42 generated.

Figure 7:
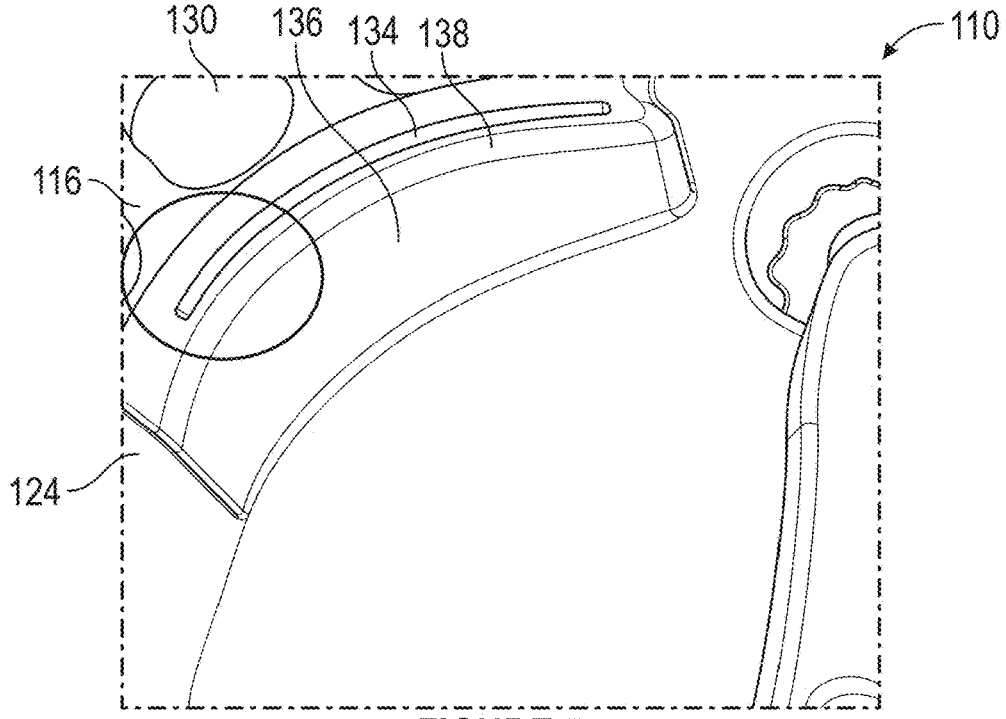
FIGS. 7 to 9 are perspective views of portions of alternative drill bits illustrating example forms of outlet port.

In the present example the outlet ports 34 are generally rectangular with rounded ends (e.g., stadium shaped), and multiple ports may be provided to cover a desired length. However, other forms of outlet port may be provided. For example, FIG. 7 is a perspective view of an alternative drill bit 110 in the region of a blade 116 which includes an outlet port 134 on a ledge 138 of a projection 136 extending from a leading face 124 of the blade 116. In this example a single outlet port 134 is provided with an extended length to provide the desired extent of drilling fluid delivery below cutting elements 130.

Figure 8:
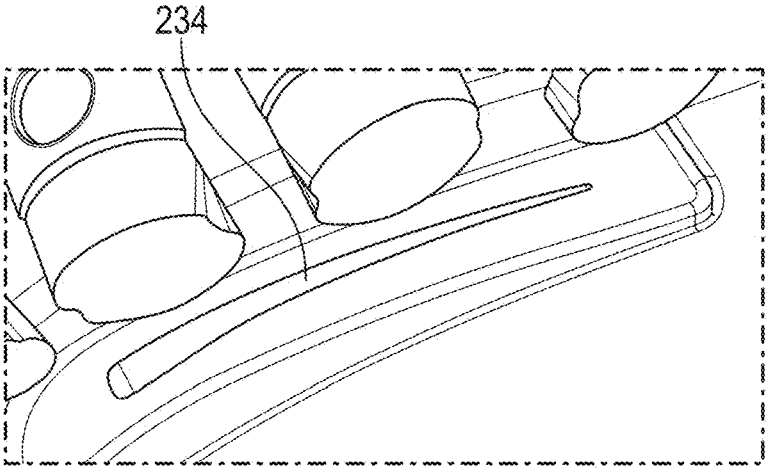

FIG. 8 provides a further example form of an outlet port 234 which is elongate and generally tear shaped, which may provide a desired outlet flow profile and may contribute to the promotion of self-cleaning.

Figure 9:
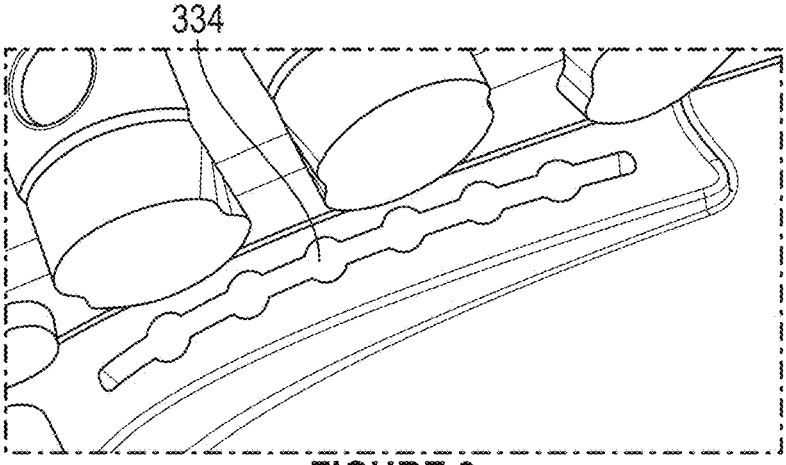

FIG. 9 provides another example form of an outlet port 334, again having an elongate profile but provided by a sequence of connected different profile sections, in this case circular and rectangular profile sections. This may provide for different flow profiles to be achieved along the length of the at least one outlet port.

It should be recognised that any suitable form of outlet port may be provided, which may be elongate as noted above, albeit with any desired profile, or indeed may be non-elongate, for example circular, square etc.

It should be recognised that the examples provided herein are merely exemplary and that various modifications may be made thereto.

The invention claimed is:

1. A drill bit, comprising:

a bit body having a body face;

a plurality of blades each extending from the bit body from a root portion adjacent the body face to a tip portion defining a cutting region, each blade having a leading face and a trailing face; and at least one outlet port disposed adjacent the leading face of at least one blade at a location between the root and tip portions of said at least one blade, the at least one outlet port for directing drilling fluid towards the cutting region of the at least one blade, wherein the at least one outlet port is elongate in a direction generally parallel with the leading face of the at least one blade, and wherein the at least one outlet port comprises a varying geometry along its length, wherein the varying geometry is defined by a slot profile that is tapered moving from a first longitudinal end of the at least one outlet port to a second longitudinal end of the at least one outlet port.

2. The drill bit according to claim 1, wherein the location of the at least one outlet port between the root and tip portions of the at least one blade is such that the at least one outlet port is elevated relative to the body face.

3. The drill bit according to claim 1, wherein the at least one outlet port is located closer to the tip portion of the at least one blade than the root portion.

4. The drill bit according to claim 1, wherein the at least one outlet port is disposed on the leading face of the at least one blade.

5. The drill bit according to claim 1, wherein the at least one outlet port is disposed on a projection extending outwardly from the leading face of at least one blade.

6. The drill bit according to claim 5, wherein the projection extends outwardly from the leading face of the at least one blade in a direction towards the trailing face of an adjacent blade.

7. The drill bit according to claim 5, wherein the projection defines a ledge, wherein the at least one outlet port is formed in or on the ledge.

8. The drill bit according to claim 7, wherein the ledge defines a profile along its length, said profile following a profile of the tip portion of the at least one blade.

9. The drill bit according to claim 7, wherein the ledge defines a flow guide to guide flow from a separate flow source towards the cutting region of the at least one blade.

10. The drill bit according to claim 5, wherein the projection is a discrete projection located between the root and tip portions of the at least one blade.

11. The drill bit according to claim 5, wherein the projection extends from the body face of the bit body in the same direction as at least a portion of the at least one blade.

12. The drill bit according to claim 5, wherein the projection extends from a projection root adjacent the body face to a projection tip intermediate the root and tip portions of the at least one blade.

13. The drill bit according to claim 5, wherein the projection is integrally formed with the at least one blade.

14. The drill bit according to claim 1, comprising at least one outlet port disposed adjacent the leading face of two or more blades.

15. The drill bit according to claim 1, comprising a plurality of nozzles disposed on the body face of the drill bit to allow the flow of drilling fluid out of the bit body.

16. The drill bit according to claim 1, wherein the cutting region of each blade comprises at least one cutting element.

17. The drill bit according to claim 16, wherein at least one cutting element projects from the leading face of a blade and at least partially over the at least one port.

18. A method for drilling a bore, comprising:

engaging a drill bit against a formation to be drilled, the drill bit comprising a bit body having a body face and a plurality of blades each extending from the bit body from a root portion adjacent the body face to a tip portion defining a cutting region, each blade having a leading face and a trailing face;

rotating the drill bit to cause the cutting region of each blade to remove material from the formation to produce drill cuttings; and flowing drilling fluid from at least one outlet port which is disposed adjacent the leading face of at least one blade at a location between the root and tip portions of said at least one blade, the drilling fluid being directed towards the cutting region of the at least one blade, wherein the at least one outlet port is elongate in a direction generally parallel with the leading face of the at least one blade, wherein the at least one outlet port comprises a varying geometry along its length, and wherein the varying geometry is defined by a slot profile that is tapered moving from a first longitudinal end of the at least one outlet port to a second longitudinal end of the at least one outlet port.

19. The method according to claim 18, comprising directing drilling fluid from the at least one outlet at a location between the cutting region and drill cuttings being removed.

20. The method according to claim 18, comprising additionally flowing drilling fluid from a plurality of nozzles disposed on the body face of the bit body.

21. A drill bit, comprising:

a bit body having a body face;

a plurality of blades each extending from the bit body from a root portion adjacent the body face to a tip portion defining a cutting region, each blade having a leading face and a trailing face;

a plurality of nozzles disposed on the body face to flow drilling fluid out of the bit body; and at least one outlet port disposed adjacent the leading face of at least one blade at a location between the root and tip portions of said at least one blade, the at least one outlet port for directing drilling fluid towards the cutting region of the at least one blade, wherein the at least one outlet port is elongate in a direction generally parallel with the leading face of the at least one blade, and wherein the at least one outlet port comprises a varying geometry along its length, wherein the varying geometry is defined by a slot profile that is tapered moving from a first longitudinal end of the at least one outlet port to a second longitudinal end of the at least one outlet port.

22. The drill bit according to claim 21, comprising a flow guide disposed on the leading face of at least one blade, the flow guide for directing a portion of drilling fluid from at least one nozzle away from the bit body towards the cutting region of the at least one blade.

* * * * *